United States Patent [19]

Friedman

[11] 4,316,299

[45] Feb. 23, 1982

[54] FITTED BED COVERING

[76] Inventor: Naomi P. Friedman, 200 Winston Dr., Cliffside Park, N.J. 07010

[21] Appl. No.: 125,838

[22] Filed: Feb. 29, 1980

Related U.S. Application Data

[63] Continuation-in-part of Ser. No. 5,657, Jan. 22, 1979, abandoned.

[51] Int. Cl.[3] ..... A47G 9/02; A47G 9/04

[52] U.S. Cl. ..... 5/485; 5/497; 5/502

[58] Field of Search ..... 5/485, 495, 497, 499, 5/500, 501, 502, 496

[56] References Cited

U.S. PATENT DOCUMENTS

| | | | |
|---|---|---|---|
| 1,865,329 | 6/1932 | McMorter | 5/497 |
| 2,679,056 | 5/1954 | Simpson | 5/497 |
| 3,832,743 | 9/1974 | Smith | 5/496 |
| 3,857,124 | 12/1974 | Hadley | 5/496 |

FOREIGN PATENT DOCUMENTS

| | | | |
|---|---|---|---|
| 821966 | 10/1959 | United Kingdom | 5/501 |
| 1093469 | 12/1967 | United Kingdom | 5/496 |

*Primary Examiner*—Roy D. Frazier
*Assistant Examiner*—Alexander Grosz
*Attorney, Agent, or Firm*—Hubbell, Cohen, Stiefel & Gross

[57] ABSTRACT

A fitted bed covering comprises two generally rectangular pieces of cloth, each having two adjacent contoured corners and two slits extending transversely from its peripheral edge, each slit being located closely adjacent one contoured corner between that contoured corner and the adjacent non-contoured corner. One of the two pieces of rectangular cloth is disposed in overlapping relation with the other and means are provided for releasably securing the two pieces of cloth together.

4 Claims, 8 Drawing Figures

FITTED BED COVERING

CROSS-REFERENCE TO RELATED APPLICATIONS

This application is a continuation-in-part of application Ser. No. 005,657, filed Jan. 22, 1979, now abandoned.

BACKGROUND OF THE INVENTION

1. Field of the Invention

This invention pertains generally to bed coverings and more particularly to fitted bed coverings.

2. Description of the Prior Art

The use of blanket bags as bed coverings is well known. Such bags typically comprise two flat sheets sewn together along three edges thereby defining a pocket for a blanket, quilt or the like which may be inserted or removed through the non-joined confronting edges of the sheets. While blanket bags provide comfort and warmth in use, they do not present a neat, contoured look when the bed is unoccupied. More specifically, and as is the case with conventional top sheets, blankets, etc., if they are not tucked under the mattress they simply hang over the sides of the bed, while if they are tucked in, the corners tend to bunch. Either way, they do not present the fitted, contoured look indicative of contemporary design. Another common problem with blanket bags is that the blankets tend to bunch up in one area inside the pocket. This is both ineffective and unattractive.

British Pat. No. 821,966 discloses a modified blanket bag wherein the length and width of the bag are substantially equal to the length and width of the bed. Dual flaps extend outwardly from the sides of the bag such that one set of flaps may be tucked under the mattress with the other flaps extending down over the bed. While this arrangement represents an improvement over conventional blanket bags, its placement on the bed is inherently time consuming because of the multiple flap arrangement.

U.S. Pat. No. 3,857,124 issued to Hadley discloses a modified blanket bag arrangement wherein the bag is defined by a top sheet and bedspread removably secured together by a zipper. The combination top sheet and bedspread is, in turn, removably secured to a bottom sheet fitted about the mattress, also by a zipper. It will be apparent that the use of zippers for securing the bedspread to the top sheet and the top sheet to the mattress results in an arrangement which unduly complicates making up the bed.

Also well known is the use of contoured sheets which serve as replaceable coverings for mattresses. In the case of conventional rectangular beds, a fitted sheet has four contoured corners which fit about the corresponding corners of the mattress. Modified contoured sheets, wherein only the foot portion of the sheet is contoured, are disclosed in U.S. Pat. Nos. 2,679,056 and 1,865,329.

SUMMARY OF THE INVENTION

According to the present invention, I have developed a fitted bed covering which can serve as a conventional top sheet or a blanket or both, and yet may be easily and quickly fitted in place for presenting a neat, contoured appearance when the bed is unoccupied. The preferred bed covering in accordance with the present invention is constructed from two generally rectangular pieces of cloth, one somewhat larger than the other. The larger piece of cloth is provided with contours at two adjacent corners and two slits extending transversely from the peripheral edge, one between each contoured corner and its adjacent non-contoured corner, the slits being located nearer the contoured corners. The smaller piece of cloth is joined along three sides of its peripheral edge to the larger piece of cloth such that the unjoined side confronts the intermediate portion of the peripheral edge of the larger piece of cloth between its non-contoured corners. Thus, a pocket closed on three sides is defined between the smaller piece of cloth and the confronting portion of the larger piece of cloth.

When the covering is in place on a bed, the two contoured corners are fitted over the corners of the mattress at the front of the bed and the peripheral edge of the flap defined by the portions of the larger piece of cloth which extend beyond the closed sides of the pocket are tucked under the mattress. When the bed is occupied, the portions of the flap on either side of the bed, that is, the portions between the transverse slits and the non-contoured corners of the larger piece of cloth, may be pulled out from under the mattress to afford freedom of movement for the occupant. Thanks to the slits, these side portions of the flap may be pulled out from under the mattress without disturbing the portion of the flap between the slits which remains tucked in. However, if desired this last-mentioned portion of the flap may also be pulled out from under the mattress in which case it is inverted to prevent the user's feet from becoming entangled therein. When additional warmth is desired, the pocket may be filled with a suitable insulator, such as a suitably dimensioned blanket, quilt, or the like. It will be apparent that the insulator may be removed through the open side of the pocket for accommodating cleaning or when the additional warmth provided thereby is not needed. In any event, for aesthetic reasons it is preferred that the length and width of the pocket be substantially the same as that of the mattress whereby the seams defining the closed sides of the pocket will extend along the edges of the mattress when the cover is in place on the bed. It will thus be apparent that the bed covering of the present invention may be quickly fitted on the bed to present a neat, contoured appearance and yet may be easily adjusted for use.

The fitted bed covering according to the invention also includes a fitted top sheet releasably secured to the underside of the basic structure described above. The fitted top sheet is of the same configuration as the larger piece of cloth in the basic structure and is provided with the same contours and flaps. The top sheet is preferably releasably secured to the underside of the basic structure by strips of hook and pile type fasteners of the type sold under the trademark Velcro. The use of a removable top sheet is advantageous because it permits the top sheet to be separated for washing or replacement. Because the top sheet has the same configuration as the larger piece of material in the basic structure, the incorporation of the top sheet does not detract from the neat, contoured appearance presented by the bed covering.

When the fitted bed covering of the invention is made of a quilted material, it is not desirable to employ a pocket for receiving a removable blanket, the reason being that inversion of the pocket for the purpose of removing and inserting the blanket becomes difficult when quilted material is used. Accordingly, in a modification of the present invention primarily intended for use with a quilted material, the smaller piece of cloth is replaced with a similarly dimensioned blanket removably secured to the undersurface of the larger piece of cloth as by strips of hook and pile type fasteners of the type sold under the trademark Velcro. The fitted top sheet described above may then be removably secured to the undersurface of the larger piece of cloth such that the blanket portion is sandwiched between the top sheet and the larger piece of cloth.

These and other features of the bed covering in accordance with the present invention will become more fully apparent from the following detailed description and annexed drawings of the preferred embodiments thereof.

DETAILED DESCRIPTION OF THE PREFERRED EMBODIMENTS

Figure 1:
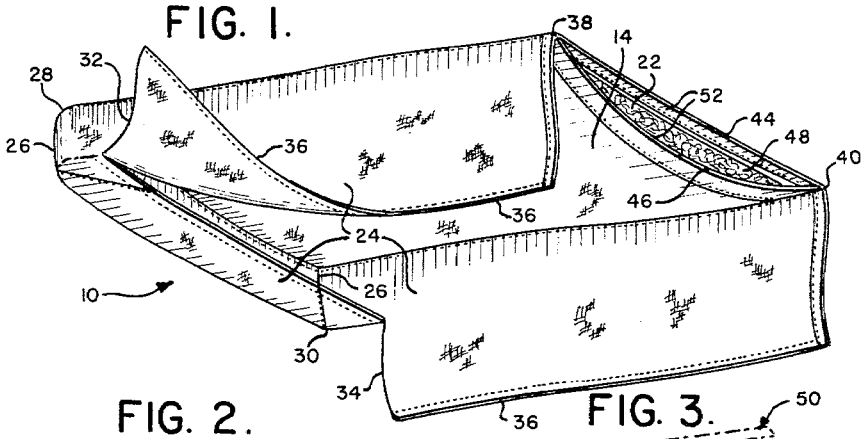
FIG. 1 is a perspective view of a preferred bed covering in accordance with the present invention.

Referring now to the drawings and initially to FIGS. 1–4 thereof, the preferred bed covering 10 in accordance with the present invention is shown. As illustrated, the covering 10 includes a first generally rectangular piece of cloth 12 and a second, smaller generally rectangular piece of cloth 14 joined along three sides of its peripheral edge to the piece of cloth 12 thereby defining a flap 24 and a pocket 22 closed on three sides 16, 18 and 20. The flap 24 has contours 26 at two adjacent corners 28 and 30 and two slits 32 and 34 which extend transversely from the peripheral edge 36 of the flap 24 between the contoured corners 28 and 30 and their respective adjacent non-contoured corners 38 and 40. As shown, and for reasons that will be more fully apparent hereinafter, the slits 32 and 34 are located nearer the contoured corners than the non-contoured corners.

The covering 10 may be made by first slitting and contouring two corners of the first piece of cloth 12 thereby forming the contoured corners 28 and 30. The slits 32 and 34 may then be cut in the cloth 12. The slits 32 and 34 are preferably then seamed and most preferably double bound by the addition of a suitable tape or the like to prevent unravelling and tearing. The piece of cloth 14 may then be positioned on the unseamed side of the piece of cloth 12 and then sewn or otherwise joined thereto along three sides of its peripheral edge. It will thus be apparent that the pocket 22 will then be defined between the piece of cloth 14 and the confronting portion of the piece of cloth 12 and that the flap 24 will be defined by the portion of the first piece of cloth 12 which extends beyond the sides 16, 18 and 20 of the pocket 22. It will also be apparent that the pocket 22 is open between the non-joined confronting edges 44 and 46 of the pieces of cloth 12 and 14, respectively. As an alternative to the suggested method of construction, the flap 24 may be formed separately from the central portion of the piece of cloth 12 and subsequently sewn or otherwise joined thereto. Whatever method of construction is employed, it will be apparent that the bed covering 10 may be constructed of any suitable flexible material selected, for example, from those commonly employed for making sheets, bedspreads, and other bed coverings. Thus, while the preferred bed covering 10 is described as being made of cloth, it should be understood that this is not necessary and that other suitable flexible materials may be used. The pieces of cloth 12 and 14, but in particular the piece of cloth 12, may be patterned, and this is in fact preferred. However, for purposes of clarity, patterning is not shown in the drawings.

While the exact dimensions of the covering 10 are not critical it should, of course, be sufficiently large to completely cover the mattress 42 or other bed part which the covering 10 is intended to overly. For reasons that will be more fully apparent hereinafter, the piece of cloth 14 is preferably substantially the same size as the mattress 42. Also, the width of the flap 24 should be greater than the height of the mattress 42 whereby the peripheral edge 36 of the flap 24 may be tucked under the mattress 42 when the bed is unoccupied as is more fully explained below.

As is apparent from FIG. 1, the pocket 22 may be filled with a suitable insulating material whose length and width is preferably substantially the same as that of the pocket 22. By way of example, the insulating material may comprise a blanket 48, although quilts and the like may also be used.

Figure 2:
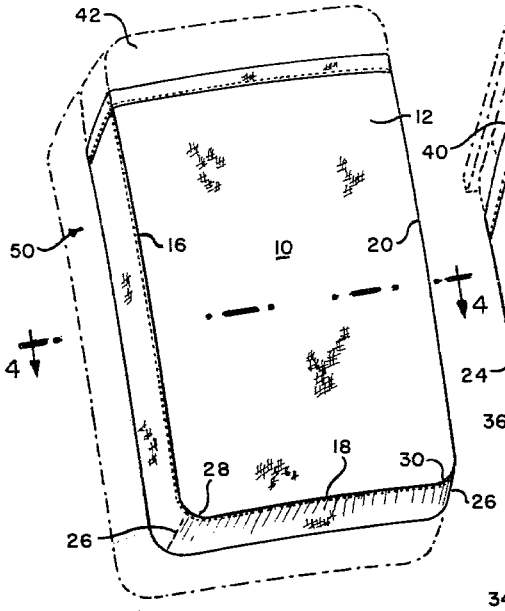
FIG. 2 is a perspective view showing the bed covering of FIG. 1 in place on an unoccupied bed.
Figure 4:
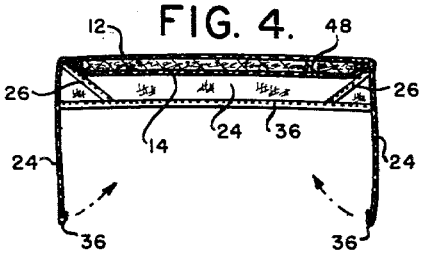
FIG. 4 is a sectional view taken substantially along the lines 4—4 in FIG. 2.

Referring now specifically to FIGS. 2 and 4, the bed covering 10 is shown in place on an unoccupied bed 50. When the covering 10 is in place, the contoured corners 28 and 30 are fitted about the corresponding corners of the mattress at the front of the bed and the peripheral edge 36 of the flap 24 is tucked under the mattress 42. As is apparent from FIG. 2, when the covering 10 is thus fitted on the bed 50, it presents a neat, contoured appearance.

Figure 3:
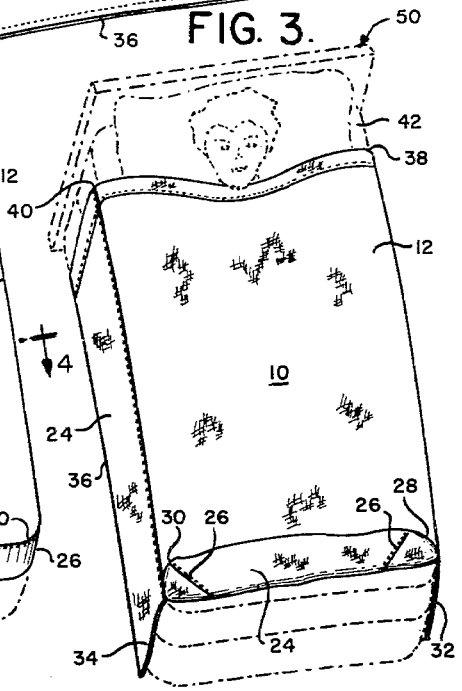
FIG. 3 is a top plan view showing the bed covering of FIGS. 1 and 2 in place on an occupied bed.

Referring now to FIG. 3, when the bed is about to be occupied, the side portions of the flap 24, that is, the portions between the slits 32 and 34 and the non-contoured corners 38 and 40, respectively, are pulled out from under the mattress 42 such that they hang down along the sides of the bed thereby providing the freedom of movement generally associated with top sheets, blankets and the like. Thanks to the slits 32 and 34, the side portions of the flap may be pulled out from under the mattress 42 without disturbing the end portion of the flap 24 between the slits which remains tucked in under the mattress. However, and as shown in FIG. 3, if complete freedom of movement is desired, the end portion of the flap 24 between the slits 32 and 34 may also be pulled out from under the mattress 42. When this is done, the end portion of the flap 24 is preferably folded upwards as shown in FIG. 3 thereby avoiding the possibility of the occupant's feet becoming entangled in the contoured corners 28 and 30 or the portion of the flap 24 therebetween. When the bed is occupied, it will be apparent that the blanket 48 disposed in the pocket 22 serves to insulate the occupant in the manner of conventional blankets and the like. When the occupant leaves the bed, the bed is made by simply fitting the contoured corners 28 and 30 about the corresponding corners of the mattress 42 and then tucking the edge 36 of the flap 24 under the mattress.

It will thus be apparent that the bed covering 10 may be quickly fitted about the mattress 42 for presenting a neat, contoured appearance when the bed is unoccupied and yet may be easily adjusted for use. It will be further apparent that when the covering 10 is made from a cloth of the type used for making sheets and the pocket 22 is filled with the blanket 48, the covering 10 serves the dual functions normally served separately by a top sheet and blanket. Of course, the covering 10 may be used in conjunction with a conventional fitted sheet which would be fitted over the mattress 42 under the covering 10.

The pocket 22 is left open between the confronting edges 44 and 46 to accommodate removal of the blanket 48 whereby the blanket 48 and covering 10 may be separately cleaned. Of course, when ambient temperatures are high, the blanket 48 may be removed from the pocket 22 during use in which case the covering 10 will serve as a top sheet with a double ply in the central portion thereof. To prevent the blanket 48 from slipping out through the open end of the pocket 22 or from bunching up in one part of the pocket during use, means such as mating strips 52 of hook and pile type fasteners of the type sold under the trademark Velcro, are preferably secured to the periphery of the underside of blanket 48 and the confronting surface portions of the piece of cloth 14 for releasably securing the blanket in place.

Figure 5:
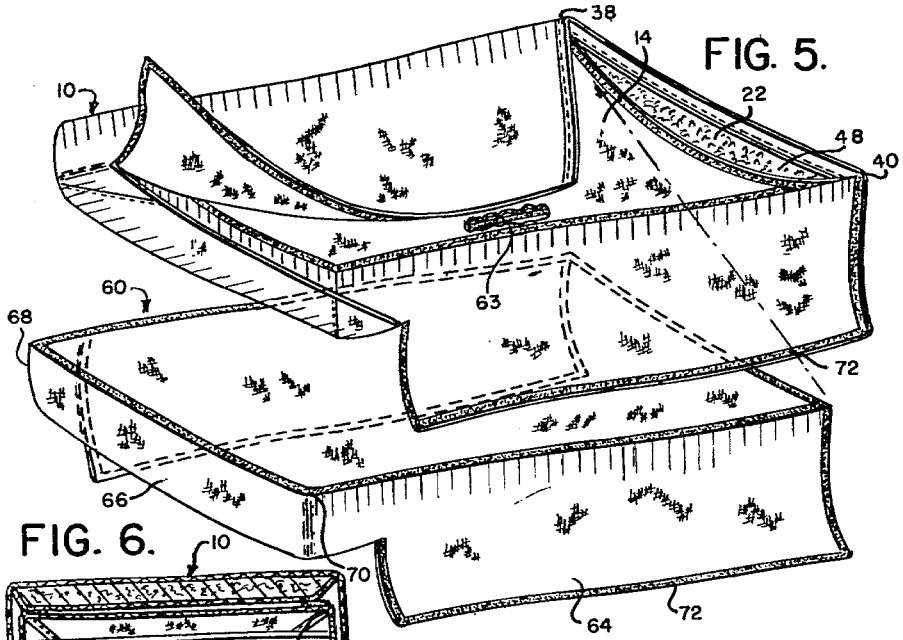
FIG. 5 is a view similar to FIG. 1 but showing the complete bed covering in accordance with the present invention.
Figure 6:
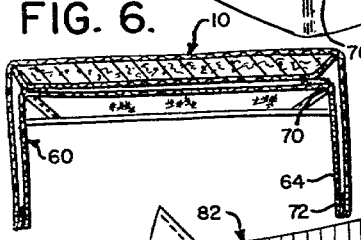
FIG. 6 is a sectional view similar to FIG. 4 showing the complete bed covering of FIG. 5.

Referring now to FIGS. 5 and 6, the bed covering 10 illustrated in FIGS. 1–4 is shown in combination with a fitted top sheet 60. The top sheet 60 has the same configuration as the larger piece of cloth 12 in the covering 10 and thus includes side flaps 64, end flap 66, and contoured corners 68 and 70. Accordingly, the top sheet 60 may be constructed in the same manner as the piece of cloth 12. As shown, the fitted top sheet 60 fits under the bed covering 10 and may be removably secured thereto as by mating strips 72 of hook and pile type fasteners of the type sold under the trademark Velcro. The embodiment illustrated in FIGS. 5 and 6 is advantageous insofar as it permits the fitted top sheet 60 to be separated from the basic fitted bed covering 10 to accommodate separate washing or replacement of the top sheet. Moreover, because the fitted sheet 60 has the same contoured configuration as the piece of cloth 12 in the covering 10, it fits neatly and easily about the mattress and does not detract from the contoured appearance presented by the bed covering.

Figure 7:
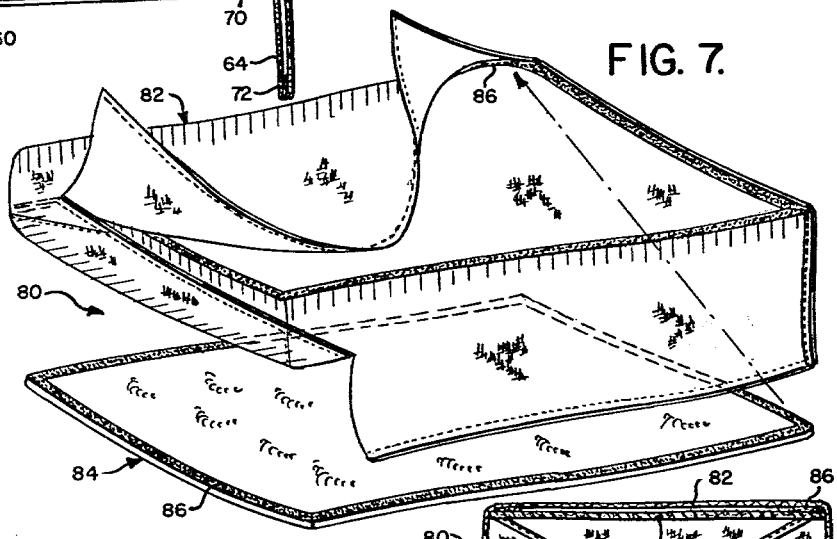
FIG. 7 is a perspective view similar to FIG. 1 showing a modified embodiment of a bed covering in accordance with the present invention.
Figure 8:
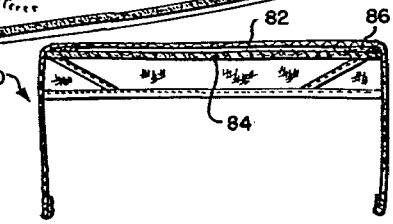
FIG. 8 is a sectional view similar to FIG. 4 showing the modified bed covering of FIG. 7.

When the bed covering 10 of FIGS. 1–4 is comprised of a quilted material, it is generally not practical to utilize a pocket for removably receiving a blanket or the like inasmuch as inversion of the pocket to insert and remove the blanket becomes difficult. A suitable modification of the fitted bed covering of the present invention for use with a quilted material is illustrated in FIGS. 7 and 8. The modified bed covering 80 comprises a quilted piece of material 82 having the same configuration as the larger piece of cloth 12 in FIGS. 1–4. The bed covering 80 also includes a blanket or other suitable insulating material 84 having the same configuration as the smaller piece of cloth 14 in FIGS. 1–4. The blanket 84 is removably secured to the undersurface of the quilted material 82, preferably by mating strips 86 of hook and pile type fasteners of the type sold under the trademark Velcro. Preferably, the strips 86 extend around the entire perimeter of the blanket 84, although it will be apparent that discontinuous strips may also be used. It will thus be apparent that the bed covering 80 may be used either with or without the blanket 84, depending upon the amount of insulation desired, and in either event will present the neat, contoured appearance characteristic of the other embodiments of the present invention. In addition, and as a further modification, the fitted top sheet 60 illustrated in FIGS. 5 and 6 may be removably secured to the undersurface of the covering 80, thereby sandwiching the blanket 84 between the sheet 60 and the quilted material 82. When the piece of material 82 is highly insulating, the blanket 84 may be eliminated in which case the fitted piece of material 82 may be used alone or with the fitted top sheet 60 removably secured to the undersurface thereof.

While I have herein shown the preferred embodiments of the present invention and have suggested several modifications thereto, it will be apparent to those skilled in the art that still further changes and modifications may be made therein without departing from the spirit and scope of the invention.

Accordingly, the above description should be construed as illustrative and not in a limiting sense, the scope of the invention being defined by the following claims:

1. A covering for a bed comprising first and second generally rectangular pieces of flexible material, each defining a peripheral edge, said first and second pieces of material each having two adjacent contoured corners, two adjacent non-contoured corners, and two slits extending transversely from its peripheral edge, each slit being located closely adjacent one contoured corner between said contoured corner and the adjacent non-contoured corner;

means for releasably securing said first and second pieces of material together with said first piece of material in overlapping relation with said second piece of material; and a third generally rectangular piece of flexible material defining a peripheral edge, the length and width of said third piece of material being substantially the same as the length and width of said bed, respectively, said third piece of material being disposed in confronting relation with said first piece of material and joined thereto along three sides of its peripheral edge with the fourth unjoined side of its peripheral edge confronting the central portion of the peripheral edge of said first piece of material between said non-contoured corners, thereby defining a pocket between said third piece of material and the confronting portion of said first piece of material.

2. The covering of claim 1, further comprising a fourth piece of flexible material whose length and width are substantially equal to the length and width of said third piece of material, respectively, said fourth piece of material being removably disposable in said pocket.

3. The covering of claim 2, wherein said releasable securing means comprises mating strips of hook and pile type fasteners of the type sold under the trademark Velcro secured to the peripheral edges of said first and second pieces of material.

4. The covering of claim 3, further comprising additional means for releasably securing said fourth side of said peripheral edge of said third piece of material to said central portion of said peripheral edge of said first piece of material.

* * * * *